US005666613A

United States Patent [19]

Kumon et al.

[11] Patent Number: 5,666,613

[45] Date of Patent: Sep. 9, 1997

[54] SEQUENTIALLY MOVING INDIVIDUAL DEVELOPING UNITS TO DEVELOPING LOCATION AT WHICH RESPECTIVE DEVELOPING UNIT IS SWITCHED BETWEEN OPERATIVE AND INOPERATIVE POSITIONS

[75] Inventors: Toshihiko Kumon, Aichi-Ken; Akinori Kaneko, Fujisawa, both of Japan

[73] Assignee: Minolta Co., Ltd., Osaka, Japan

[21] Appl. No.: 555,886

[22] Filed: Nov. 13, 1995

[30] Foreign Application Priority Data

Nov. 11, 1994 [JP] Japan ..... 6-277530
Jun. 15, 1995 [JP] Japan ..... 7-147967

[51] Int. Cl.[6] ..... G03G 15/01

[52] U.S. Cl. ..... 399/227

[58] Field of Search ..... 355/245, 251, 355/326 R, 327; 118/645; 399/227, 228

[56] References Cited

U.S. PATENT DOCUMENTS 4,713,673 12/1987 Kessoka ..... 355/245
4,728,987 3/1988 Diola et al. ..... 355/3 DD
4,922,301 5/1990 Katoh et al. ..... 355/251
5,198,866 3/1993 Kimura et al. ..... 355/326

*Primary Examiner*—Joan H. Pendegrass
*Attorney, Agent, or Firm*—Sidley & Austin

[57] ABSTRACT

A developing apparatus for developing an electrostatic latent image formed on a photoconductive member has a plurality of developer units supported by a rotatable supporting device, an elastic member such as a spring which rotates the supporting device through a predetermined angle to sequentially position the developer units in a developing position, and a switching device which switches the position among the developing units. The switching device has an accumulating device such as an electric motor which accumulates the energy in the elastic member, and a releasing device which releases the energy accumulated in the elastic member to effect the rotation of the supporting device and substantially instantaneous switching of the developer units.

22 Claims, 8 Drawing Sheets

SEQUENTIALLY MOVING INDIVIDUAL DEVELOPING UNITS TO DEVELOPING LOCATION AT WHICH RESPECTIVE DEVELOPING UNIT IS SWITCHED BETWEEN OPERATIVE AND INOPERATIVE POSITIONS

FIELD OF THE INVENTION

The present invention relates generally to a developing apparatus, and more particularly to a using toner for developing apparatus for developing electrostatic latent images formed on the surface of a photoconductive member of, for example, a full color copier or printer, including a switching device for quickly switching among a plurality of developing units.

BACKGROUND OF THE INVENTION

In recent years, various full color copiers and printers of the electrophotographic type have been proposed. Developing apparatus used in such copiers and printers typically require four developing units, which respectively accommodate colored toner of cyan (C), magenta (M), yellow (Y), and black (Bk), the first three of which correspond to the three primary colors of red (R), green (G), and blue (B). Each of the four developing units is capable of being switched to an operative position commonly referred to as the "developing position."

A common full color developing apparatus is a rotary type wherein a plurality of developing units are integratedly supported by a support member capable of being rotated at a predetermined angle employing a motor as a drive source. "High-speed" switching of the developing units (e.g., switching in about 0.4 second or less) is determined from the perspective of high-speed image formation. When carrying out high-speed switching using a motor as a drive source, however, a powerful and expensive motor must be used. This is disadvantageous because it adds to the cost of manufacture of the apparatus and typically requires more energy to power the motor.

In such full color developing apparatus of the conventional rotary type, the individual developing units are typically fixedly mounted on the support member. When the developing units are exchanged or replaced, however, the positioning of the developing units must be precisely adjusted relative to the photoconductive member, which requires the inclusion of a high-precision mechanism in the rotary apparatus and complex fine-adjustment by skilled personnel. This also increases over-all costs.

SUMMARY OF THE INVENTION

This invention provides a developing apparatus for developing an electrostatic latent image formed on a photoconductive member of, for example, a full color copier or printer. The developing apparatus includes a plurality of developer units, each having a different color toner, for example, which develop the electrostatic latent image formed on the photoconductive member, a rotatable supporting device which supports the plurality of developer units, an elastic member which provides energy for rotating the supporting device through a predetermined angle, and a switching device which includes an accumulating device which accumulates the energy in the elastic member, and a releasing device which releases the accumulated energy in the elastic member to effect rotation of the supporting device.

In a preferred embodiment of the invention, the elastic member comprises a spring, and the accumulating device comprises an electric motor. The motor accumulates and stores the energy in the spring by turning in one direction, and releases the energy accumulated or stored in the spring by turning in another (opposite) direction.

The supporting device for supporting the plurality of developer units is capable of rotating the developer units to sequentially arrange the developer units at a developing position facing the photoconductive member. The supporting device is rotated through a predetermined angle substantially instantaneously by means of the energy stored in the elastic member. When arranged at the developing position, a developer unit is movable between a first operative position where development may be carried out, and a second inoperative position where development may not be carried out. The position of a developer unit already arranged at the developing position is switched between the first and second positions via a spring, which biases the developer unit arranged at the developing position toward the first operative position.

A control means of this invention operates the accumulating device during an image-forming operation so as to collect energy in the elastic member, and operates the releasing device after completion of the image-forming operation to rotate the supporting device to carry the plurality of developer units through the predetermined angle via the elastic member.

In the present invention, each developer unit is not fixed in its mounting to the supporting device, but, rather, is mounted so as to be movable between the aforementioned first operative developing position and the second inoperative position. When each developer unit is switched or moved to the developing position, a positioning device positions the supporting device at a predetermined angle and positions the developer unit at the developing position. Thus, the developer units can be accurately set at the developing position and precision fine-adjustment is not necessary when switching the developer units.

Each developer unit includes a development sleeve supported by a shaft, and the switching device includes a mechanism that latches the shaft of the development sleeve with a supporting member of the photoconductive member. The positioning device is constructed so as to press against the support shaft of the development sleeve. The support shaft is, in turn, connected to the supporting member of the photoconductive member so as to position the developer unit at the developing position, which allows for accurate developer unit positioning.

In use, the releasing device of the developing apparatus does not operate while an image is being exposed onto the photoconductive member, while one of the developer units is developing the latent image formed on the photoconductive member, or while an image developed by one of the developer units is being transferred to an image recording medium.

Accordingly, an object of the present invention is to provide a developing apparatus which uses an inexpensive drive source, rather than an expensive motor as a drive source, and which is capable of switching developer units very quickly.

Another object of the present invention is to provide a developing apparatus which does not require fine adjustments to achieve simple and accurate positioning of each developer unit thereof relative to the photoconductive member.

Other features and advantages of the invention will be apparent from the drawings and more detailed description that follows.

DESCRIPTION OF THE PREFERRED EMBODIMENTS

Figure 1:
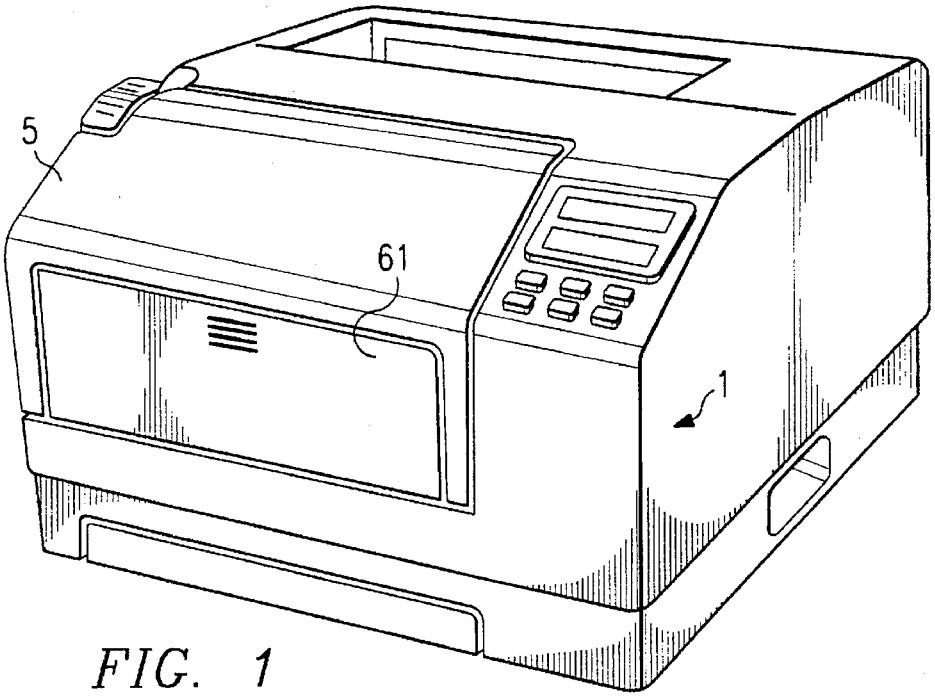
FIG. 1 is a perspective view of a laser printer provided with a developing apparatus according to a preferred embodiment of the present invention.

Presently preferred embodiments of the developing apparatus of the present invention are described hereinafter with reference to the accompanying drawings, wherein like reference numerals refer to identical elements of the invention throughout the several views.

General Construction of the Printer

Figure 2:
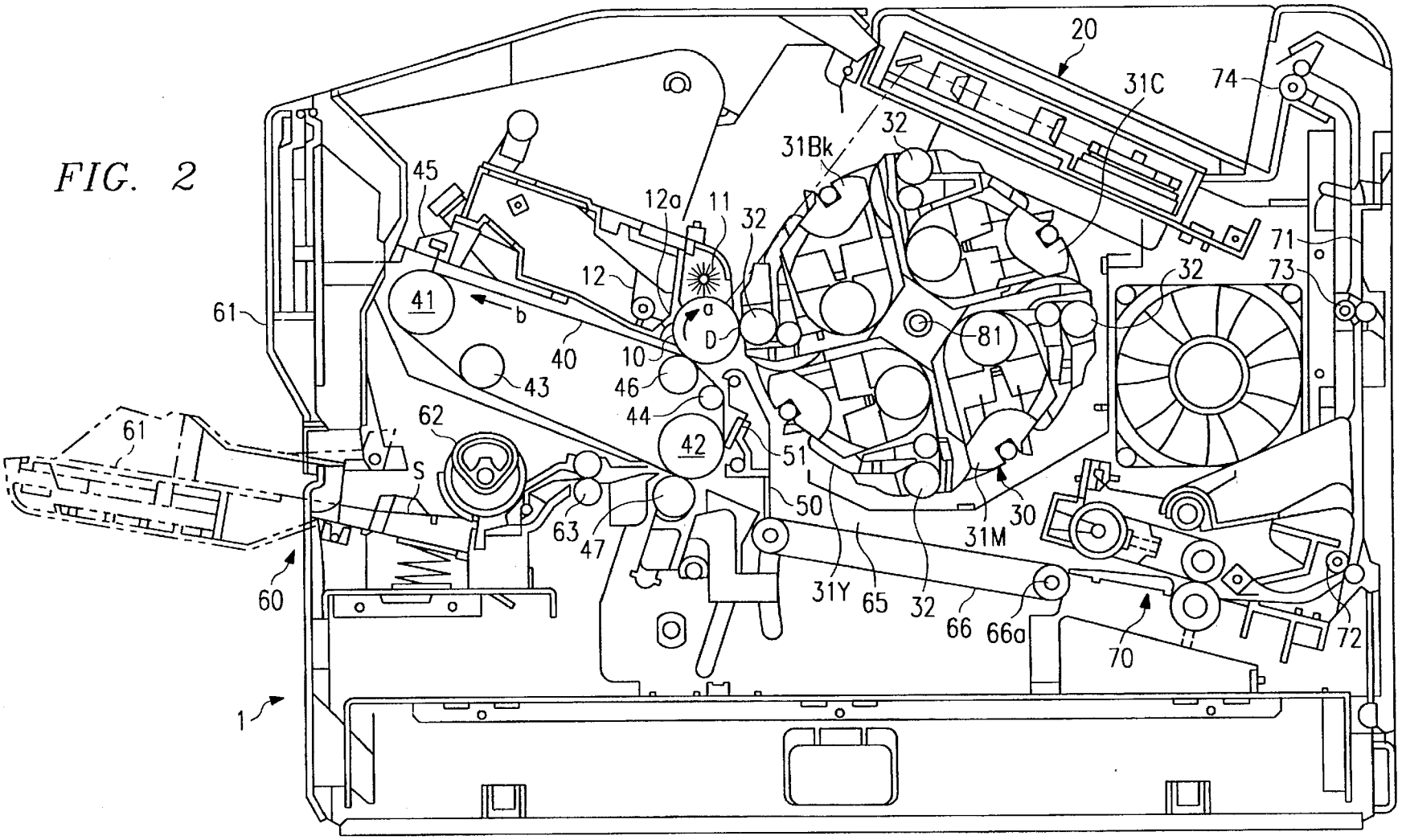
FIG. 2 shows an internal plan view of the printer of FIG. 1.

FIG. 1 shows a perspective view of a full color laser printer 1 and FIG. 2 shows an internal plan view of printer 1. Referring to FIG. 2, printer 1 generally comprises a photoconductive member in the form of a photosensitive drum 10 rotatably driven in the direction of arrow "a," a laser scanning unit 20, a full color developing apparatus or unit 30, an intermediate transfer belt 40 rotatably driven in the direction of arrow "b," and a paper supply section 60.

Arranged around the periphery of photosensitive drum 10 are a charger 11 and a cleaner 12. Charger 11 uniformly charges the surface of photosensitive drum 10 to a predetermined potential. Cleaner 12 removes the residual toner from the surface of photosensitive drum 10 by means of a blade 12*a*.

Laser scanning unit 20 is a well-known type provided with a built-in laser diode, a polygonal mirror, and an f-theta optical element. Unit 20 receives print data of cyan (C), magenta (M), yellow (Y), and black (Bk) from a host computer (not shown), and outputs print data for each color as sequential beams, which scan the surface of photosensitive drum 10 to form electrostatic latent images of each color on the surface of the drum 10.

Figure 3:
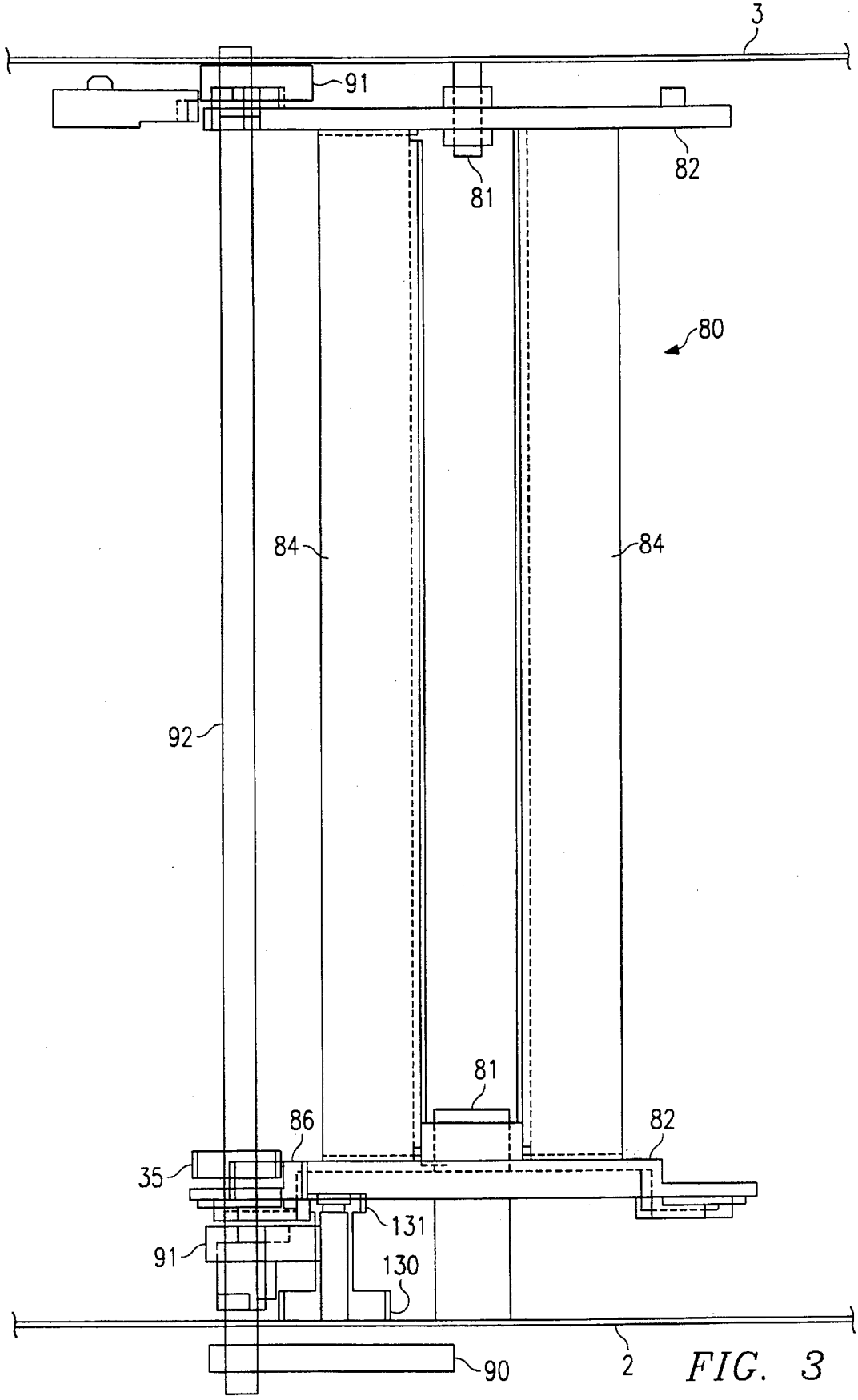
FIG. 3 shows an enlarged isolation view of the developing rack supporting the developer devices of this invention.
Figure 4:
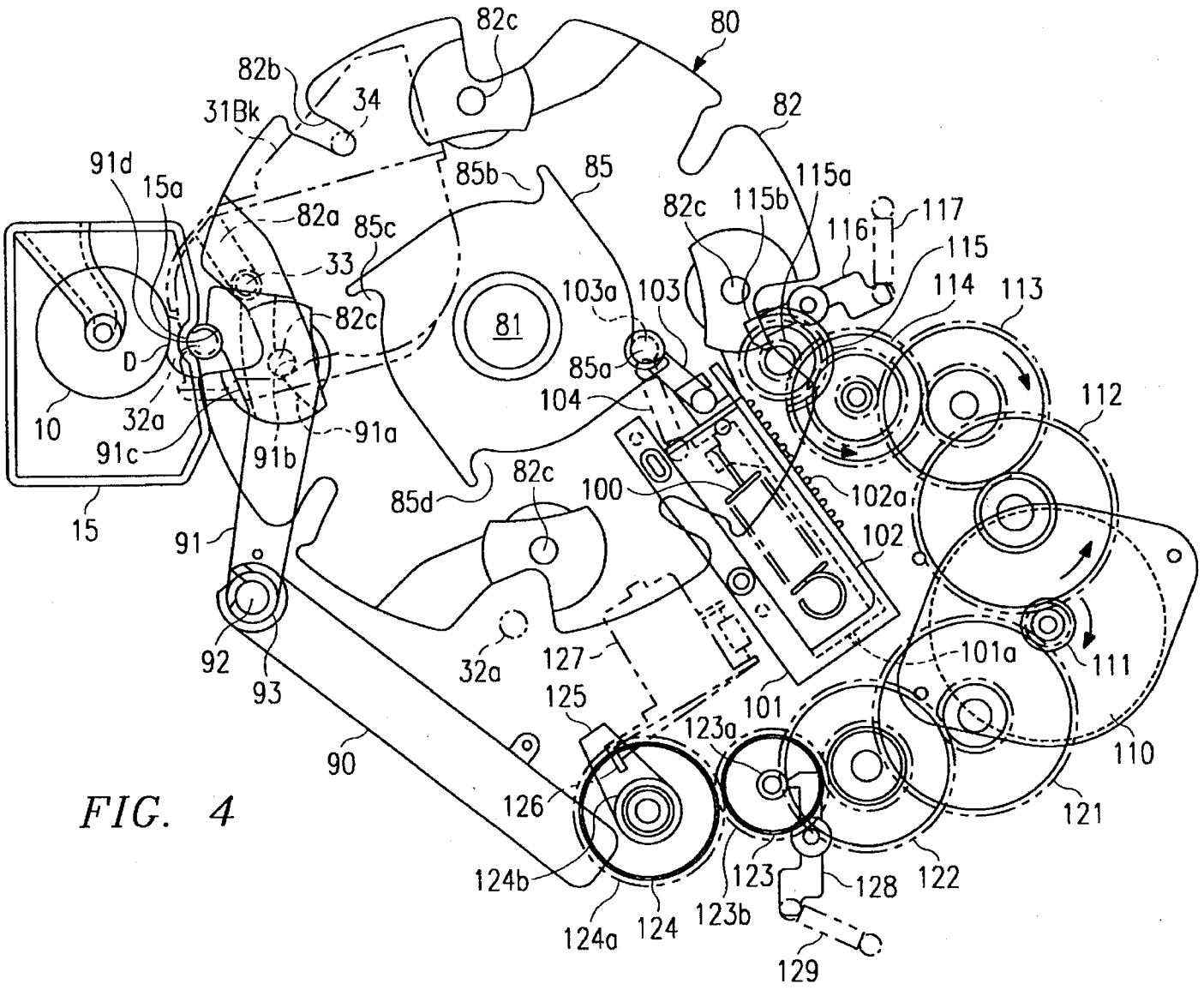
FIG. 4 is a side view showing the developer device switching mechanism of the invention before charging.

Full color developing unit 30 is provided with four separate color developer devices or units 31C, 31M, 31Y, and 31Bk, which accommodate developers containing C (cyan), M (magenta), Y (yellow), and Bk (black) toners, respectively. The four separate developer devices 31C, 31M, 31Y and 31Bk are mounted on a developing rack 80 (see FIGS. 3 and 4). Referring particularly to FIG. 4, developing rack 80 is rotatable in a clockwise direction on a shaft 81. Each developer device can be selectively rotated so as to position at a developing position "D" the developing sleeve 32 of each developer device corresponding to the electrostatic latent image of each color formed on the surface of photosensitive drum 10. In the present embodiment, a full color developing unit 30 of the rotary type is utilized so as to allow for a compact form for the printer 1.

Intermediate transfer belt 40, shown best in FIG. 2, is an endless belt looped around support rollers 41 and 42 and tension rollers 43 and 44, and is rotatably driven in the direction of arrow "b" synchronously with the rotation of photosensitive drum 10. A side of belt 40 is provided with a protrusion (not shown); and control of exposure, developing, transfer and like image-forming processes is carried out by detecting the protrusion on belt 40 by means of a microswitch 45.

Intermediate belt 40 presses against a freely rotating primary transfer roller 46 such that belt 40 comes into contact with the photosensitive drum 10. This section of contact is commonly referred to as the "primary transfer section". Belt 40 circumscribes a horizontal transport path 65 (discussed below) for recording sheets at the section supported by support roller 42, whereat the belt 40 comes into contact with a freely rotating secondary transfer roller 47. This contact section is generally referred to as the "secondary transfer" section.

A cleaner 50 for removing residual toner from belt 40 is provided in a space medial to developing unit 30 and intermediate transfer belt 40. Cleaner 50 is provided with a cleaning blade 51 which, along with the secondary transfer roller 47, can be selectively brought into contact with and separated from the intermediate transfer belt 40.

Paper supply section 60 comprises a paper tray 61, a feed roller 62, and a timing roller 63. Paper tray 61 is removable from the front side of the body of printer 1 (i.e., the side at which an operator normally stands). Recording sheets "S" are individually fed from the paper tray 61 in which they are stacked, one sheet at a time, in the right direction in FIG. 2 by rotation of feed roller 62. An individual recording sheet S is fed, via timing roller 63, to the secondary transfer section at secondary transfer roller 47 synchronously with an image formed on intermediate transfer belt 40.

Horizontal transport path 65 for the recording sheets is comprised of an air-suction belt 66 and the like. A vertical transport path 71 extends upwardly from a fixing device 70 and comprises transport rollers 72, 73, and 74. A recording sheet S is ejected from the vertical transport path 71 onto the top surface of the body of printer 1.

Full Color Printing Operation

The full color printing operation of the present embodiment of the invention is described briefly below.

During the initial print operation (first color image formation), secondary transfer roller 47 and cleaning blade 51 are separated from the intermediate transfer belt 40, and the black developer device 31Bk is positioned at the developing position D. When the print operation is initiated, the photosensitive drum 10 is rotated in the direction of arrow "a" and intermediate transfer belt 40 is rotated in sync at an identical speed in the direction of arrow "b," whereupon the surface of photosensitive drum 10 is uniformly charged to a predetermined potential by the charger 11.

The developer device switching operation is initiated in conjunction with the starting of the print operation, whereupon the yellow developer device 31Y is moved to the developing position D. Yellow image exposure is then accomplished by the laser scanning unit 20 so as to form an electrostatic latent image of the yellow image on the surface of the photosensitive drum 10. This latent image is then directly developed by the yellow developer device 31Y, and the toner image is transferred onto intermediate transfer belt 40 at the primary transfer section.

After completion of the yellow primary transfer, the magenta developer device 31M is then moved to the developing position D, whereupon magenta image exposure, developing, and primary transfer are accomplished. Similarly, the cyan developer device 31C is then moved to the developing position D whereupon cyan image exposure, developing and primary transfer are accomplished. Then, the black developer device 31Bk is moved to the developing position D whereupon black image exposure, developing and primary transfer are accomplished. The toner images of each successive primary transfer are overlaid one upon another on intermediate transfer belt 40.

When the final primary transfer has been completed, secondary transfer roller 47 and cleaning blade 51 are brought into contact with the intermediate transfer belt 40. At this time, the recording sheet S is transported to the secondary transfer section, and the full color toner image formed on the intermediate transfer belt 40 is transferred onto the recording sheet S thereat. When the secondary transfer has been completed, secondary transfer roller 47 and cleaning blade 51 are separated from the intermediate transfer belt 40.

Developing Unit Construction and Switching Mechanism

The construction of the developing unit 30 and its switching mechanism are described hereinafter.

Figure 9:
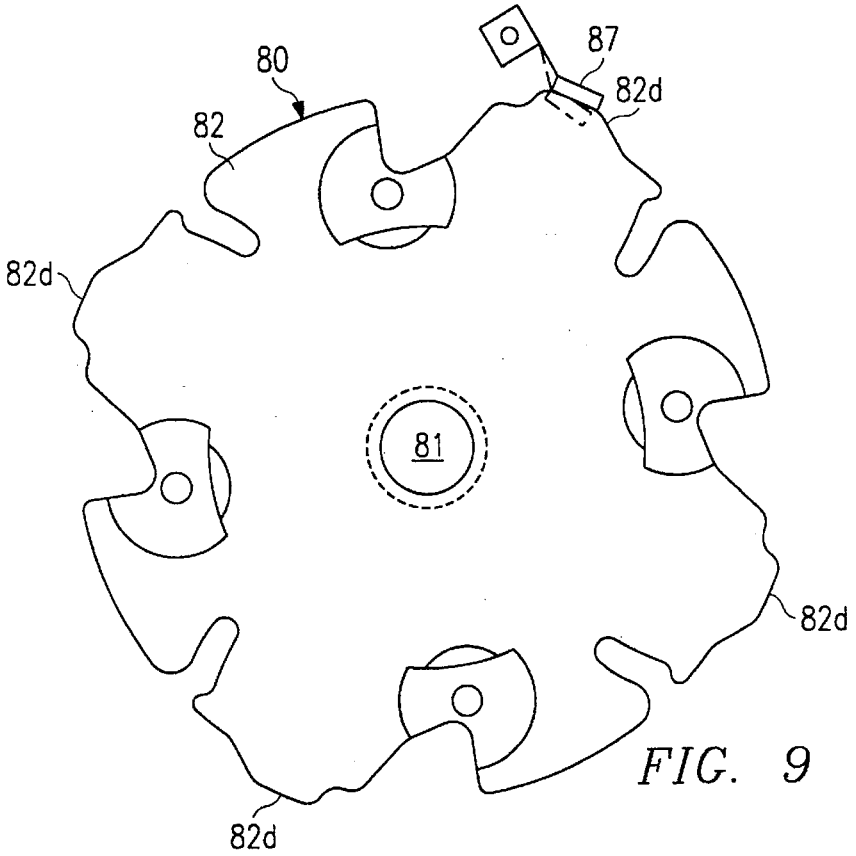
FIG. 9 is a side view of a friction braking mechanism of the developing apparatus of the invention.

Each developer device 31C, 31M, 31Y and 31 Bk is supported on the developing rack 80. As shown in FIGS. 3 and 9, developing rack 80 includes a pair of generally circular side panels 82 connected by a pair of reinforcing panels 84, and is mounted on and extends between frames 2 and 3 of the body of printer 1 so as to be rotatable upon a pair of support shafts 81 secured to frames 2 and 3. Each developer device has a shaft 33 and pin 34 (FIG. 4) provided bilaterally of the developer device, and is mounted to developing rack 80 by the engagement of shaft 33 and pin 34 with channels **82*a* and 82*b* formed generally in the periphery of the side panels 82 of rack 80. Each developer device, when installed on developing rack 80, is able to oscillate through a slight angle about the shaft 33. The range of this oscillation is between a first operative developing position, at which the developing sleeve 32 engages and is in contact with photosensitive drum 10, and a second retracted inoperative position slightly removed from the developing position such that developing sleeve 32 is moved or swung out of engagement with drum 10**.

Locking levers 90 and positioning levers 91 are mounted on frame 2 such that they are integratedly rotatable about a shaft 92 (shown best in FIG. 3). Locking levers 90 and positioning levers 91 are forced in a counterclockwise direction (as seen in FIG. 4) by a torsion spring 93 coiled around shaft 92. Positioning levers 91 are fixedly mounted on both ends of shaft 92, and are provided with guide channel **91*a* and first concavity 91*b*, and guide face 91*c* and a second concavity 91*d* (all shown most clearly in FIGS. 7A and 7B**).

First concavity **91*b* engages one of pins 82*c* provided at four locations on side panel 82 so as to lock the developing rack 80 at predetermined angles. These "lock" positions correspond to the positions at which the individual developer devices 31C, 31M, 31Y and 31 Bk are selectively moved to the developing position D. Second concavity 91*d* engages the shaft 32*a* of developing sleeve 32 of the particular developer device moved to the developing position D, whereupon the shaft 32*a* is pressed into a concavity 15*a* of a holder 15 of photosensitive drum 10 (see FIGS. 4 and 6), such that the developer device is locked in the first operative developing position at which the developing sleeve 32 comes into contact with photosensitive drum 10**.

Figure 5:
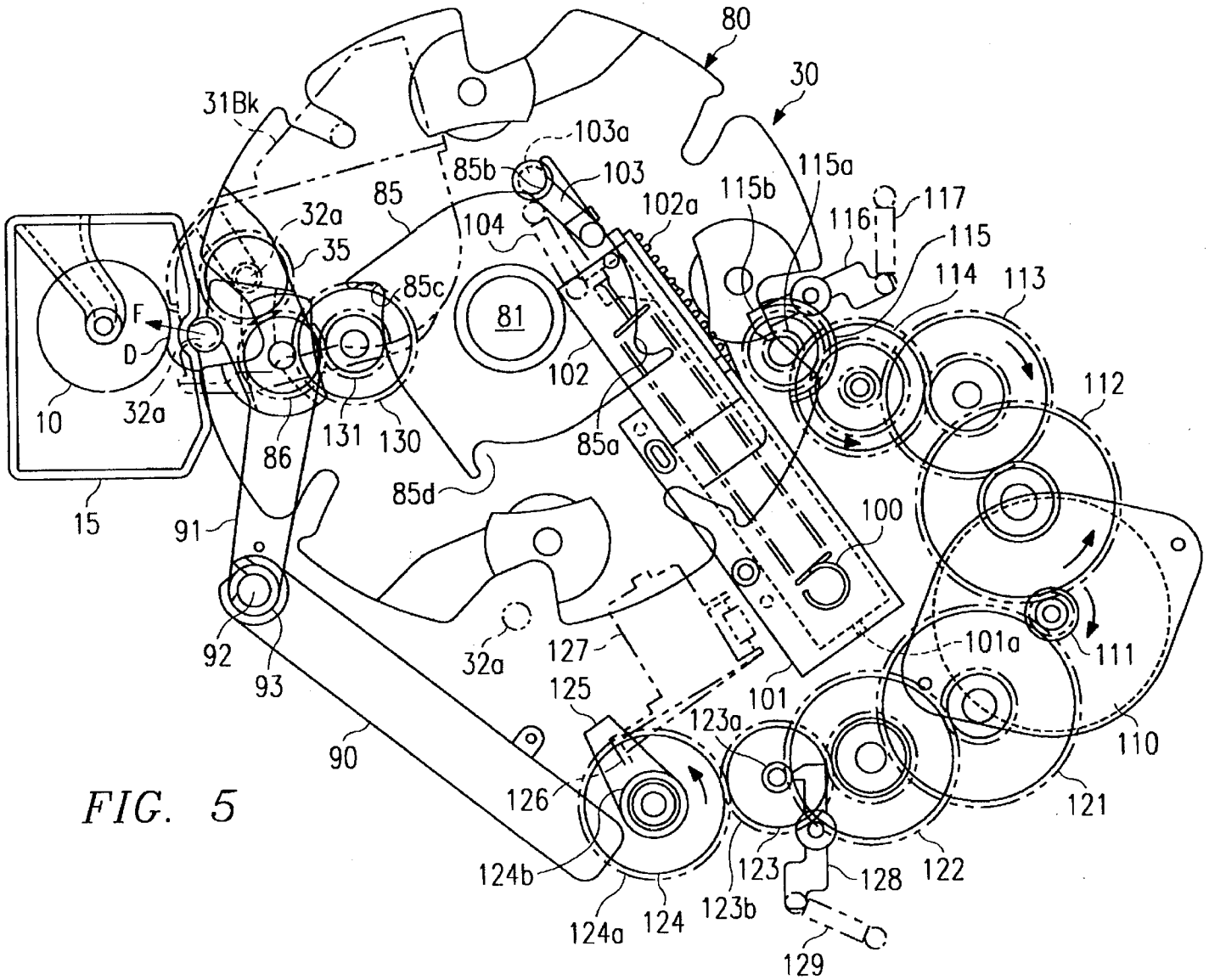
FIG. 5 is a side view showing the developer device switching mechanism of the invention after charging.

Referring now particularly to FIGS. 4 and 5, when the developer devices are switched, energy is exerted by a coiled charge spring 100 to rotate the developing rack 80 through a predetermined angle (90 degrees) in a clockwise direction. A slider 102 is slidably housed in a holder 101, to which is attached the bottom end of charge spring 100. The top end of charge spring 100 is attached to slider 102, which includes a rack **102*a* formed on the side thereof. A rack-push lever 103 is connected to the top end of slider 102, and a pin 103*a* is provided at the leading end of rack-push lever 103. A connector panel 85 is fixedly mounted to the side panel 82 of rack 80 and is provided with four concavities 85*a*–85*d* spaced 90 degrees apart from one another about the periphery of connector panel 85. A coil-type orientation spring 104 is provided medially to slider 102 and rack-push lever 103 such that a force is exerted by spring 104 to cause pin 103*a* to press against the side surface of connector panel 85**.

Still referring to FIGS. 4 and 5, a reversible motor 110 is employed to accumulate energy in the charge spring 100. When motor 110 is driven in the clockwise direction, an output gear 111 connected to the drive shaft of motor 110 transmits energy to a charge gear 115, via a series of reduction gears 112, 113, and 114. Charge gear 115 engages the rack **102*a* of slider 102. Charge gear 115 is rotated in a clockwise direction via reduction gears 112–114 such that slider 102 is moved upward (as seen in FIG. 5) by means of the engagement between charge gear 115 and rack 102*a*. At this time, charge spring 100 is extended so as to accumulate a spring force, and pin 103*a* of rack-push lever 103 rises along the side surface of connector panel 85 in conjunction therewith, such that the pin 103*a* engages the next concavity 85*b*. At this time, the developing rack 80 is locked in position by the engagement of pin 82*c* in concavity 91*b* of positioning lever 91, such that there is no obstruction to the accumulation of spring force by charge spring 100 and the engagement of pin 103*a* in concavity 85*b*. This charging operation (i.e., the charging of charge spring 100) is carried out at the start of the print operation and during the previous color exposure, development, and primary transfer, and typically requires about 4.0 seconds to complete. Thus, the time required for charging allows for an extra 2.5 seconds to achieve adequate charging, even by a relatively weak and small-sized motor 110**.

When the motor 110 rotates in the reverse direction (counterclockwise in FIGS. 4 and 5), the output gear 111 of motor 110 transmits power to a lock release gear 124 via a second series of reduction gears 121, 122, and 123. Reduction gear 123 includes a first gear element 123*a* which engages reduction gear 122, and a second gear element 123*b* equipped with a boss which engages lock release gear 124. Both gear elements 123*a* and 123*b* are connected to a one-way spring (not shown). The boss of gear element 123*b* includes a ratchet tooth formed thereon such that a hook member 128 engages the ratchet tooth via a force exerted by a coil spring 129 to prevent gear element 123*b* from rotating in a counterclockwise direction. Accordingly, when motor 110 rotates normally in a clockwise direction, gear element 123*b* is prevented from rotating and first gear element 123*a* slips relative to the second gear element 123*b* such that the rotational force of motor 110 is not transmitted to the lock release gear 124. When the motor 110 rotates in the reverse (counterclockwise) direction, however, gear elements 123*a* and 123*b* are connected by the aforementioned one-way spring (not shown) such that they rotate integratedly in a clockwise direction.

Figure 6:
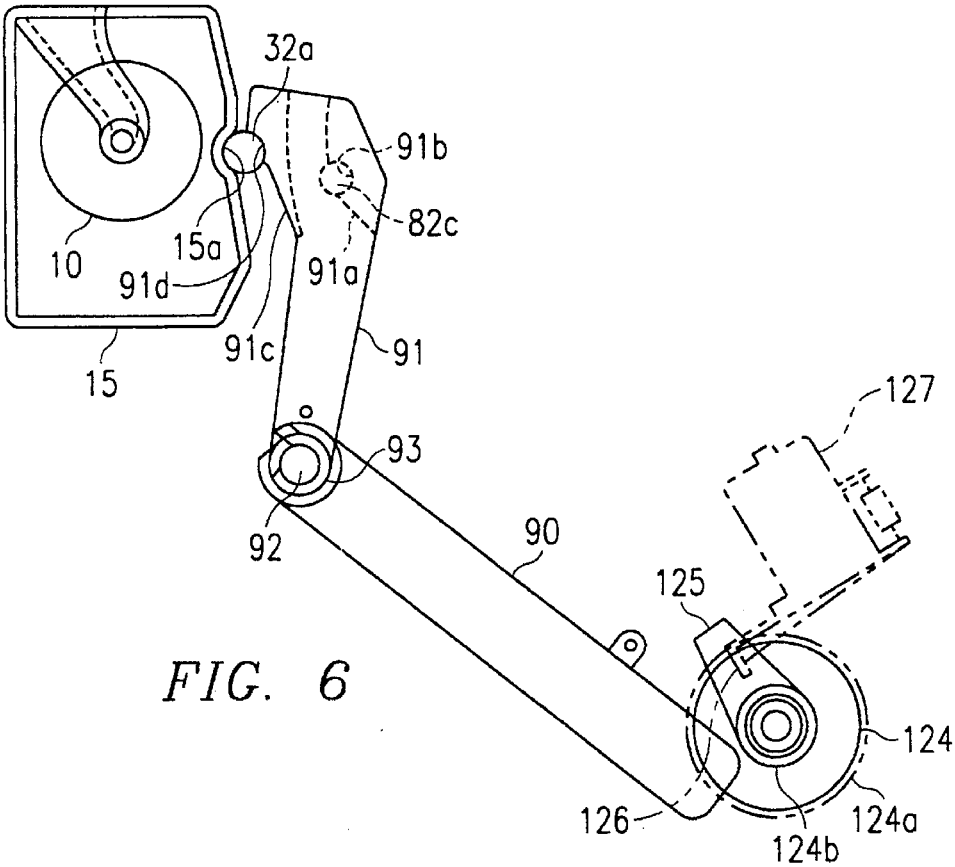
FIG. 6 is a side view showing the locking mechanism of the developer device and developing rack.

Lock release gear 124 also has a dual construction comprising a gear element 124*a* and a ring member 124*b*, both of which are connected by a one-way spring (not shown). Gear element 124*a* engages the second gear element 123*b* of reduction gear 123. Ring member 124*b* is provided with a cam 125 and includes a ratchet tooth formed on its exterior surface. As shown in FIGS. 4–6, a hook member 126 engages the ratchet tooth to prevent ring member 124*b* from rotating in a counterclockwise direction. Hook member 126 is mounted on and controlled by a solenoid 127 to engage ring member 124*b* when the solenoid is deactivated (OFF), and to release ring member 124*b* when the solenoid is activated (ON).

Switching Operation

After energy has accumulated in the charge spring 100, and after completion of the primary transfer of the toner image formed on photosensitive drum 10 to the intermediate transfer belt 40, the developer device switching operation is then carried out. If switching were carried out immediately after development is completed, the quality of the toner image is often adversely affected by oscillation induced by the switching operation because the primary transfer is interrupted. To resolve this problem, the switching operation is not carried out in the present invention until the primary transfer operation has been completed.

The switching operation is accomplished in this invention by the reverse rotation of motor 110 in the counterclockwise direction to momentarily activate, i.e., turn "ON," the solenoid 127. Upon solenoid 127 being activated, hook member 126 releases or disengages from ring member 124*b* such that gear element 124*a* engages ring member 124*b* via the spring force applied by the one-way spring (not shown), whereupon the reverse rotation of motor 110 is transmitted to the ring member 124*b*. The transmission of the reverse (counterclockwise) rotation of motor 110 to ring member 124*b* causes the ring member 124*b*, lock release gear 124 and cam 125 to rotate cooperatively in the same counterclockwise direction, such that cam 125 and locking lever 90 rotate in the clockwise direction. Positioning lever 91 is also rotated in the clockwise direction against the spring force of the torsion spring 93 in conjunction with the rotation of the-locking lever 90 because lever 91 is connected to lever 90 via shaft 92. The locks on the developing rack 80 (pin 82*c*) and on the developer device (sleeve shaft 32*a*) are also released in conjunction with the rotation of positioning lever 91, whereupon the developing rack 80 becomes free and is rotated in a clockwise direction about shaft 81 via the force accumulated in the charge spring 100 (i.e., the retraction of spring 100 back to an unextended "uncharged" state as shown in FIG. 4).

The locking release of developing rack 80 via the positioning lever 91 is only momentary because lever 91 returns in a counterclockwise direction via the spring force of torsion spring 93 when the developing rack 80 rotates 90 degrees. Upon the developing rack 80 rotating 90 degrees, rack 80 is again temporarily locked in position by the next pin 82*c* engaging the concavity 91*b* of positioning lever 91, whereupon the next developer device is locked in position by the engagement between sleeve shaft 32*a* in concavity 91*d* and concavity 15*a* of holder 15. As noted above, at this point, charge spring 100 has retracted or recoiled to its initial uncharged state as shown in FIG. 4 from its charged state shown in FIG. 5.

The rotational direction during the switching operation discussed above is the direction for supplying toner to the developing sleeve 32 from inside the developer device as the developer device moves to developing position D such that the re-supply of sufficient toner is accomplished even when the developer device is operated immediately after being moved to the developing position D.

Control Sequence

Figure 12A:
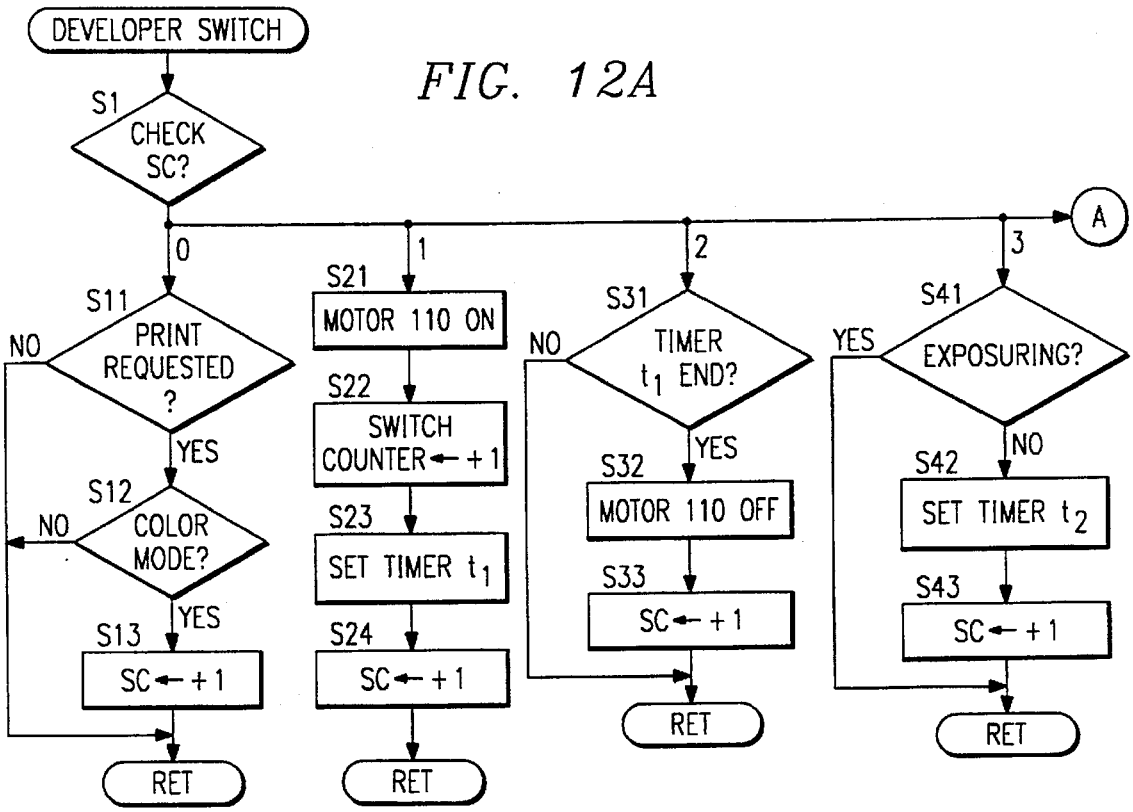
FIGS. 12A and 12B collectively present a flow chart showing the control sequence of the developer device switching operation of the invention.
Figure 12B:
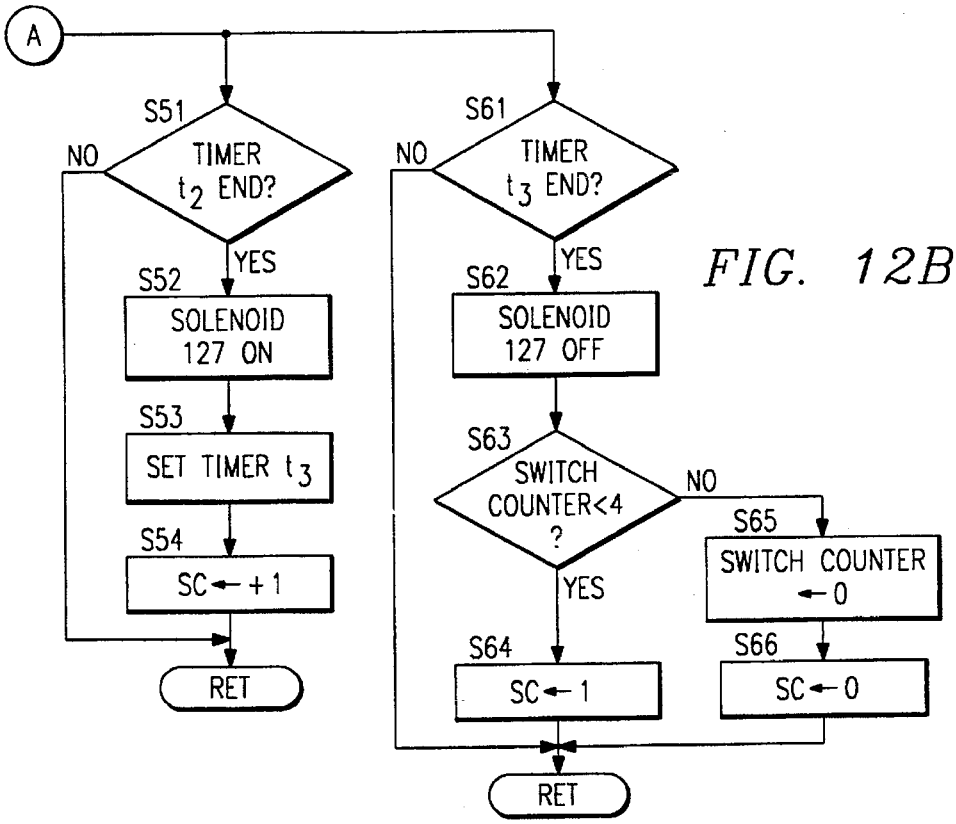

The control sequence for the developer device switching operation is described hereinafter with particular reference to the flow charts of FIGS. 12A and 12B.

Switching the developer devices is accomplished by checking the count value 1–5 of the state counter SC in step S1, and executing the process in accordance with the count value.

The value of the state counter SC is set initially at zero [0]. In step S11, a check is made to determine whether a print request has been received by the printer. If a print request has been received, the color mode selection is confirmed in step S12, and the state counter SC is incremented by a single count in step S13. If a print request has not been received, or if the color mode of the printer has not been selected by the operator, the state counter SC value remains at zero [0] and the developer device switching operation is not executed at that time.

When the state counter SC is set at one [1], the charge spring 100 immediately begins to accumulate energy by the activation of motor 110 in step S21 and a switching counter is incremented by a single count in step S22. The switching counter counts the number of changes (maximum of four) of the developer devices. Then, in step S23, a charge timer t1 is set and, in step S24, the state counter SC is incremented by a single count.

Charge timer t1 stipulates the ON time of motor 110 (i.e., the time during which motor 110 is activated), which corresponds to the charging time of spring 100. When the completion of charge timer t1 is confirmed in step S31, motor 110 is deactivated (turned OFF) in step S32, and state counter SC is incremented by a single count in step S33. At that point, the charging of charge spring 100 has been completed and spring 100 is in a fully charged (extended) state as shown in FIG. 5. In the present embodiment, the set time of charging counter t1 is about 3.0 seconds. When motor 110 comprises a step motor 110, the charging time need not be timed but rather may be determined by a drive pulse count.

When the state counter SC is set at three [3], a check is made in step S41 to determine whether an exposure operation is currently being executed. If so, the system waits for the exposure operation to be completed, and then sets a lock release wait timer t2 in step S42 and the state counter SC is incremented by a single count in step S43. Lock release wait timer t2 stipulates the timing for releasing the lock of developing rack 80. The set time of timer t2 is equivalent to the time interval from the end of the exposure process to the end of the primary transfer process. When the end of timer t2 is confirmed in step S51 (FIG. 12B), the solenoid 127 is activated (turned ON) in step S52, which effects the switching of the developer devices. Lock release wait timer t2 prevents the developer device switching operation from being carried out during either the exposure operation or the primary transfer operation. Accordingly, timer t2 is necessary at the start of a print operation, and if motor 110 is in a deactivated state (OFF mode) (step S32), the solenoid 127 may be activated (turned ON) (step S52).

Finally, in step S53, a solenoid timer t3 is set, and the state counter SC is incremented by a single count in step S54. Solenoid timer t3 is set at a short period of about 500 ms to momentarily activate (turn ON) the solenoid 127. When the end of solenoid timer t3 is confirmed in step S61, the solenoid 127 is deactivated (turned OFF). At that point, the next developer device is temporarily locked in position at the developing position D.

In a one-page, full-color print operation, the developer devices are switched four times. Thus, the count value of the selection counter is determined in step S63. If the count value is less than four [4], the state counter SC is reset at one [1] in step S64, whereupon the routine returns to step S21 (FIG. 12A) and the charging operation is repeated. If the selection counter count value is four [4], the switch counter and the state counter are reset to zero [0] in steps S65 and step S66, respectively, whereupon the developer device selection operation terminates.

Return of Charger to Home Position

Referring again to FIGS. 4 and 5, the charging gear 115 is provided with a number of teeth sufficient to move slider 102, via the clockwise rotation of charging gear 115, upwardly only until the pin 103*a* of rack-push lever 103 engages concavity 85*b*. Charging gear 115 comprises a first gear element 115*a* which engages reduction gear 114, and a second gear element 115*b* which engages rack 102*a*. Gear elements 115*a* and 115*b* are connected to each other by a one-way spring (not shown). A single ratchet tooth is provided on the boss of second gear element 115*b* such that a hook member 116 engages the ratchet tooth via a force exerted thereon by a coil spring 117 to prevent the reverse rotation of second gear element 115*b* in the counterclockwise direction.

During the charging operation, the clockwise rotation of motor 110 extends the charge spring 100 as described above via the forward rotation of charging gear 115 because the gear elements 115*a* and 115*b* are connected via the one-way spring (not shown). After the charging operation is completed, motor 110 reverses its rotation in the counterclockwise direction, which, in turn, causes charging gear 115 to also tend to reverse its rotation in the counterclockwise direction, but the reverse rotation of charging gear 115 is prevented by the engagement of the hook member 116 with the ratchet tooth of second gear element 115*b*, such that thereafter first gear element 115*a* idles because the one-way spring does not exert a force thereon, that is, charging gear 115 returns to its initial position because second gear element 115*b* is prevented from any reverse rotation by the hook member 116.

Locking and Impact Absorption by Positioning Lever

Figure 7A:
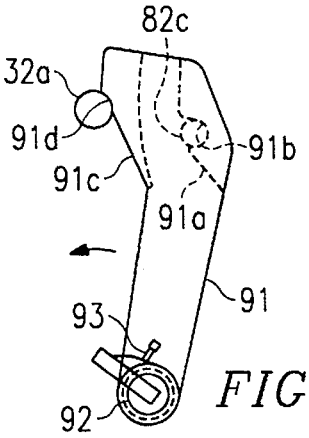
FIG. 7A shows a side view of the locking mechanism of the invention in a locked position.

As previously described, positioning lever 91 temporarily locks developing rack 80 at a rotation angle of 90 degrees via the engagement of pin 82*c* in concavity 91*b* and the exerted force of torsion spring 93 such that the sleeve shaft 32*a* engages concavity 91*d*. The developer device is thereby locked at the developing position via the pressure of sleeve shaft 32*a* on the concavity 15*a* of holder 15 of photosensitive drum 10 (FIGS. 6 and 7A). Immediately preceding the locking of the positioning lever 91 (i.e., immediately preceding the completion of the switching operation), pin 82*c* oscillates in the guide channel 91*a* of positioning lever 91 such that sleeve shaft 32*a* oscillates on guide face 91*c* and returns somewhat in a clockwise direction. More specifically, just before the switching operation is completed, pin 82*c* and sleeve shaft 32*a* exert a dampening braking force on the developing rack 80 as it rotates by means of a frictional force imparted via the oscillation of positioning lever 91 to cushion the impact on the developing rack 80 and the developer device during the locking operation.

Each developer device freely oscillates through a slight angle about its shaft 33 (FIG. 4) carried by developing rack 80. When the sleeve shaft 32*a* is switched to the developing position D, shaft 32*a* engages the concavity 15*a* of holder 15 of photosensitive drum 10 by way of the pressure exerted by positioning lever 91 so as to lock rack 80 in the first operative developing position as previously described. Thus, the developer device is positioned with a high degree of precision at the first operative developing position, at which the developing sleeve 32 is in contact with the photosensitive drum 10. When developer devices are exchanged, and when individual developer devices are mounted in developing rack 80, complex, fine adjustments are not required to position the devices inasmuch as the necessary positioning is accomplished by the engagement between shaft 33 and pin 34 and the channels 82*a* and 82*b*, respectively, of side panel 82.

Figure 7B:
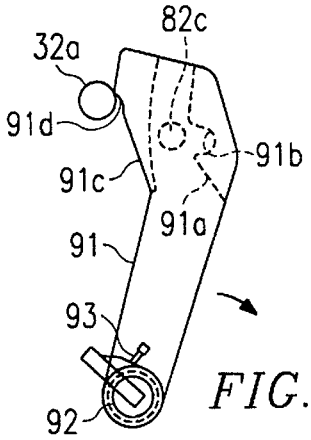
FIG. 7B shows a side view of the locking mechanism of the invention in a released position.

Conversely, when a developer device is removed from the developing position D, the lock is released by positioning lever 91, whereupon the sleeve shaft 32*a* releases from engagement with the concavity 91*d*, pivots on shaft 33 in a counterclockwise direction, and rides on the concavity 15*d* of holder 15, as shown in FIG. 7B.

Drive Transmission Mechanism to Developing Devices

Figure 8:
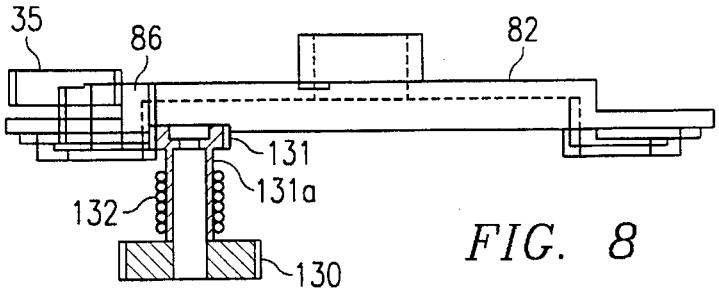
FIG. 8 is a section view of a drive force transmission mechanism coupled to the developing apparatus of the invention.

Each developer device supplies toner to the photosensitive drum 10 by the rotation of developing sleeve 32 so as to develop a latent image formed on drum 10. In order to rotate developing sleeve 32, drive gears 130 and gear 131 are provided on frame 2 of the printer (see FIGS. 3 and 5), and four rack gears 86 (for clarity, only one rack gear 86 is shown in FIG. 5) are rotatably mounted on rack side panel 82, and the shaft 33 of each developer device is provided with a developing gear 35 to engage rack gear 86, as shown in FIGS. 3, 5, and 8. Developing gear 35 rotates the developing sleeve 32. Drive gear 130 and gear 131 share a common shaft and are connected by a spring force exerted by a one-way spring 132 (FIG. 8) coiled around a hub 131*a* of gear 131.

Rack gear 86 engages drive gear 131 shortly before the next developer device is moved to the developing position D by the switching operation described above. During a print operation, drive gear 130 is rotatingly driven in a clockwise direction. There is some concern, however, that gears 86 and 130 may be damaged by the impact caused by the rack gear 86 directly engaging the drive gear 130. In the present embodiment, however, drive gears 130 and 131 are connected by one-way spring 132 such that gear 131 rotates via one-way spring 132 and, when an excessive load is exerted on the gear 131, one-way spring 132 slips on the hub 131*a*. In this fashion, the friction between one-way spring 132 and hub 131*a* absorbs any excessive load when the rack gear 86 engages the gear 131, thereby dampening any force that might prevent the rotation of drive gear 130 and preventing damage to gears 86, 130, and 131.

The relative positions of rack gear 86 and developing gear 35 as shown in FIG. 5 are set so that the counterclockwise rotational force received by rack gear 86 from gear 131 is applied in the direction of arrow F relative to the developer device. The force exerted in the direction of arrow F causes the sleeve shaft 32*a* to be pressed against holder 15, and improves the positioning accuracy of the developer device at the developing position. The force applied in the direction of arrow F is slightly upward such that sleeve 32*a* is removed from the concavity 15*a* of holder 15 when a developer device is removed from the developing position D.

Air Dampening Mechanism

When a developer device is switched, an impact is imparted to the developing unit 130 due to the spring force accumulated on the charge spring 100. In order to absorb this impact, the present invention provides that the oscillation section of holder 101 and slider 102 has an airtight construction, and that a hole 101*a* is provided in the bottom of holder 101 as shown in FIGS. 4 and 5. When the developing rack 80 is released, thereby causing charge spring 100 and slider 102 to suddenly return to their unextended, uncharged positions shown in FIG. 4, the air in holder 101 acts as an air dampening mechanism to brake the slider 102. Thus, the impact during switching can be absorbed and adverse affects on image quality prevented.

Friction Braking Mechanism

An effect similar to that of the air dampening mechanism described above can be accomplished by using a friction braking mechanism such as that shown in FIG. 9, which can be employed in conjunction with or in place of the air dampening mechanism. As shown in FIG. 9, each rack side panel 82 includes four protrusions 82*d* formed on the peripheral surface thereof. A brake plate 87 can be provided to apply elastic pressure on the protrusions 82*d*. Brake plate 87 can be activated to apply pressure on the protrusions 82*d* shortly before the switching operation is completed.

Torsion Prevention on Rack Sides

Figure 10:
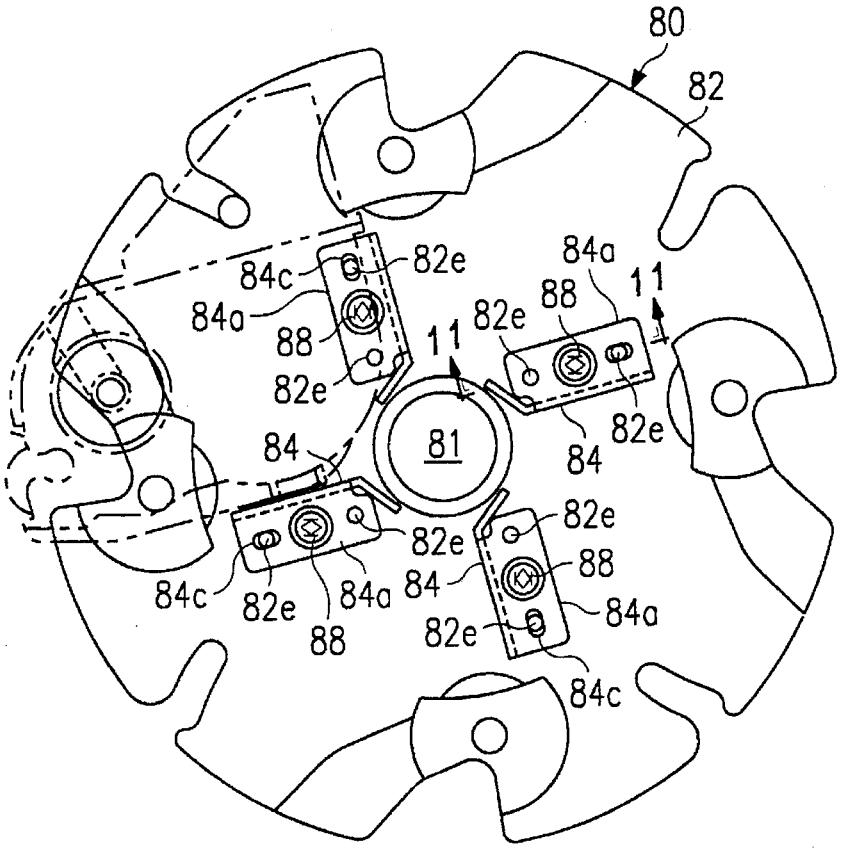
FIG. 10 is a side view showing the mounting of reinforcement panels onto the developing apparatus of the invention.
Figure 11:
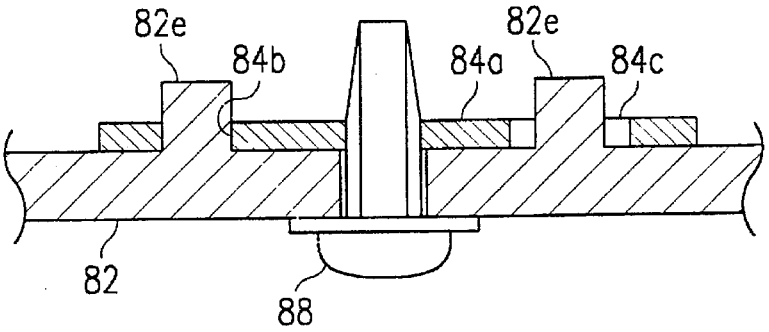
FIG. 11 is a section view taken along the A—A perspective of FIG. 10.

Referring now to FIGS. 10 and 11, to prevent the rack side panels 82 from experiencing any undesirable torque during operation, reinforcement panels 84 having members 84*a* can be fixedly mounted by screws 88 to the side panels 82. When reinforcement panels 84 are mounted only by screws 88, the panels 84 may still experience twisting due to the rotational moment generated during the tightening of screws 88. In the present embodiment of the invention, a boss 82*e* is provided on rack side panels 82 to engage holes 84*b* and 84*c* formed in the side panel member 84*a* to prevent the twisting of rack side panels 82. One hole 84*c* may be formed as a slot to compensate for errors in manufacture if desired.

Manual Rack Rotation Mechanism

When the toner contained in the developer devices is completely consumed, the developer devices must be naturally replaced. To this end, when air suction belt 66, which defines part of the horizontal sheet transport path 65 shown in FIG. 2, is rotated downward upon a shaft 66*a* in conjunction with the opening of the front cover 5 (FIG. 1) of the printer body, thereby opening horizontal transport path 65, the locking lever 90 is rotated in a clockwise direction in conjunction therewith. Positioning lever 91 is cooperatively rotated in the clockwise direction in conjunction with the rotation of locking lever 90 so as to release the locked state of the developing rack 80 and the developer devices. While unlocked, the developing rack 80 can be rotated manually 90 degrees in a clockwise direction to remove the developer device from the developing position D.

The developing unit of the present invention is not limited to the previously described preferred embodiments, and may be variously modified insofar as such modifications do not depart from the scope of the invention. For example, the present invention is applicable not only to apparatus which print images from image data received from an external device, but also to full color copiers provided with a document image reading means. Furthermore, the holder 101 may be sealed and the air contained therein used as an air spring, in place of the previously described charge spring 100, as a means of applying energy to rotate the developing rack 80. Accordingly, the invention is to be limited only insofar as is required by the scope of the following claims.

What is claimed is:

1. A developing apparatus for developing an electrostatic latent image formed on a photoconductive member, comprising:

a plurality of developer units which develop the electrostatic latent image formed on the photoconductive member;

a supporting device which supports said plurality of developer units and which is capable of rotating while supporting said plurality of developer units;

an elastic member which provides energy for rotating said supporting device through a predetermined angle;

an accumulating device which causes an accumulation of energy in said elastic member; and a releasing device which releases the energy accumulated in said elastic member to effect the rotation of said supporting device.

2. The developing apparatus according to claim 1 wherein said releasing device does not operate to release the energy accumulated in said elastic member while an image is being exposed onto the photoconductive member.

3. The developing apparatus according to claim 1 wherein said releasing device does not operate to release the energy accumulated in said elastic member while one of said plurality of developer units is developing the electrostatic latent image formed on the photoconductive member.

4. The developing apparatus according to claim 1 wherein said releasing device does not operate to release the energy accumulated in said elastic member while an image developed by one of said plurality of developer units is being transferred to an image recording medium.

5. The developing apparatus according to claim 1 further comprising an arranging device which arranges one of said plurality of developer units at a developing position facing the photoconductive member.

6. The developing apparatus according to claim 1 wherein said elastic member comprises a spring.

7. The developing apparatus according to claim 1 wherein said accumulating device comprises a motor.

8. The developing apparatus according to claim 1 wherein each of said plurality of developer units carries a developer of a different color.

9. A developing apparatus for developing an electrostatic latent image formed on a photoconductive member, comprising:

a plurality of developer units which develop the electrostatic latent image formed on the photoconductive member;

a supporting device which supports said plurality of developer units and which is capable of rotating while supporting said plurality of developer units;

an elastic member which provides energy for rotating said supporting device through a predetermined angle; and a motor which causes an accumulation of energy in said elastic member by turning in one direction and which releases the energy accumulated in said elastic member by turning in another direction.

10. The developing apparatus according to claim 9 further comprising an arranging device which arranges one of said plurality of developer units at a developing position facing the photoconductive member.

11. The developing apparatus according to claim 9 wherein said elastic member comprises a spring.

12. The developing apparatus according to claim 9 wherein each of said plurality of developer units carries a developer of a different color.

13. A developing apparatus for developing an electrostatic latent image formed on a photoconductive member, comprising:

a plurality of developer units which develop the electrostatic latent image formed on the photoconductive member;

a switching device which switches a developer unit used for developing the electrostatic latent image among said plurality of developer units, said switching device including an elastic member for accumulating energy for switching the developer unit; and a controller which controls said switching device to switch the developer unit substantially instantaneously by releasing the energy accumulated in said elastic member.

14. A developing apparatus for developing an electrostatic latent image formed on a photoconductive member, comprising:

a plurality of developer units which develop the electrostatic latent image formed on the photoconductive member;

a supporting device which supports said plurality of developer units and which is capable of rotating so as to arrange one of said plurality of developer units at a developing position facing to the photoconductive member;

a driving device which rotates said supporting device so as to arrange one of said plurality of developer units at the developing position; and a switching device which switches the position of the developer unit arranged at the developing position between a first operative position at which development of the electrostatic latent image formed on the photoconductive member may be carried out and a second inoperative position at which development may not be carried out;

wherein the switching by the switching device of the position of the developer unit arranged at the developing position is performed independently of the other developer units which are not arranged at the developing position.

15. The developing apparatus according to claim 14 wherein said switching device includes an elastic member which biases a developer unit positioned at the developing position toward the first operative position.

16. The developing apparatus according to claim 14 wherein each of said plurality of developer units has a development sleeve supported by a shaft, and wherein said switching device has a mechanism which latches the shaft of the development sleeve with a supporting member of said photoconductive member.

17. The developing apparatus according to claim 14 wherein said driving device includes an elastic member capable of accumulating energy for rotating said supporting device.

18. The developing apparatus according to claim 17 wherein said driving device rotates said supporting device substantially instantaneously by releasing the energy accumulated in said elastic member.

19. A developing method for developing an electrostatic latent image formed on a photoconductive member, said method comprising the steps of:

supporting a plurality of developer units with a supporting device which is capable of rotating;

accumulating energy in an elastic member;

releasing energy accumulated in said elastic member to effect rotation of the supporting device;

stopping rotation of the supporting device so as to locate one of said plurality of developer units at a developing position facing the photoconductive member; and developing the electrostatic latent image with the developer unit which is located at the developing position by the step of stopping rotation.

20. A method in accordance with claim 19, further comprising repeating, for each remaining one of said plurality of developer units, the steps of accumulating energy, releasing energy, stopping rotation, and developing.

21. A developing method for developing an electrostatic latent image formed on a photoconductive member, said method comprising the steps of:

supporting a plurality of developer units with a supporting device which is capable of rotating;

rotating said supporting device to locate one of said plurality of developer units at a developing position facing said photoconductive member, with the thus located developer unit being at an inoperative position at which development of the electrostatic latent image cannot be developed;

switching the developer unit located at the developing position from its inoperative position to an operative position at which development of the electrostatic latent image can be developed, with such switching of the developer unit located at the developing position being conducted independently of the other developer units; and developing the electrostatic latent image with the developer unit which is positioned in its operative position.

22. A method in accordance with claim 21, further comprising repeating, for each remaining one of said plurality of developer units, the steps of rotating, switching, and developing.

* * * * *